United States Patent [19]

Muller et al.

[11] Patent Number: 5,058,673

[45] Date of Patent: Oct. 22, 1991

[54] HYDRAULICALLY SET PACKER USEFUL WITH INDEPENDENTLY SET STRADDLE PACKERS INCLUDING AN INFLATE/DEFLATE VALVE AND A HYDRAULIC RATCHET ASSOCIATED WITH THE STRADDLE PACKERS

[75] Inventors: Laurent E. Muller, Houston; Ervin Randermann, Jr., Beasley; James M. Upchurch, deceased, late of Sugar Land, all of Tex., by Marilyn Upchurch, executrix

[73] Assignee: Schlumberger Technology Corporation, Houston, Tex.

[21] Appl. No.: 576,327

[22] Filed: Aug. 28, 1990

[51] Int. Cl.[5] ..... E21B 33/127

[52] U.S. Cl. ..... 166/187; 166/191

[58] Field of Search ..... 166/187, 191, 119, 122; 277/34.6

[56] References Cited

U.S. PATENT DOCUMENTS 4,366,862 1/1983 Brandell .
4,567,944 2/1986 Zunkel et al. ..... 166/191 X
4,706,746 11/1987 White et al. .
4,729,430 3/1988 White et al. ..... 166/106
4,877,086 10/1989 Zunkel .
4,951,747 8/1990 Coronado ..... 166/187
4,962,815 10/1990 Schultz et al. ..... 166/387

*Primary Examiner*—William P. Neuder
*Attorney, Agent, or Firm*—Henry N. Garrana; John H. Bouchard

[57] ABSTRACT

A novel hydraulic set packer is set independently of the setting of two other straddle packers, the straddle packers being set by other than hydraulic means, such as by inflation or compression. If the straddle packers are set by inflation, a novel inflate deflate valve is associated with both straddle packers for providing an additional method to deflate the inflatably set straddle packer. If the straddle packers are compression set, it may be necessary to allow a top staddle packer to set only after the bottom straddle packer is already set, that is, the top straddle packer is not permitted to set when the straddle packer assembly is being pushed into a deviated/horizontal borehole or through a restriction in the borehole. Accordingly, a novel hydraulic ratchet, disposed above a bottom straddle packer on a tubing but below the top straddle packer on the tubing, will enable the top straddle packer to set only after the bottom straddle packer is already set.

24 Claims, 4 Drawing Sheets

FIG. 1
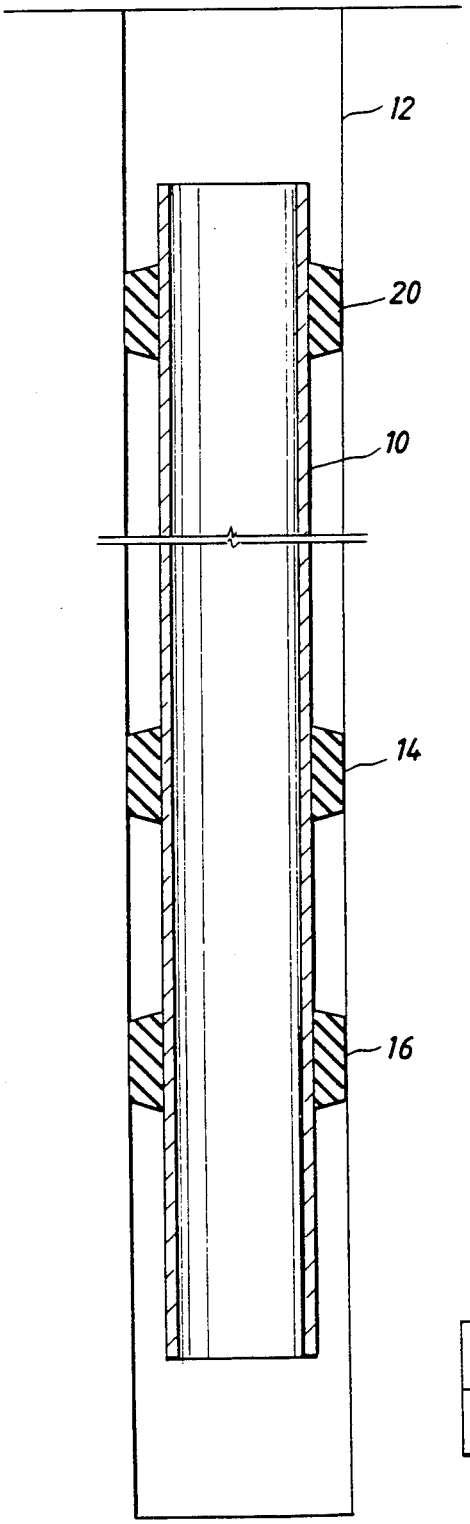
FIG. 2
(PRIOR ART)
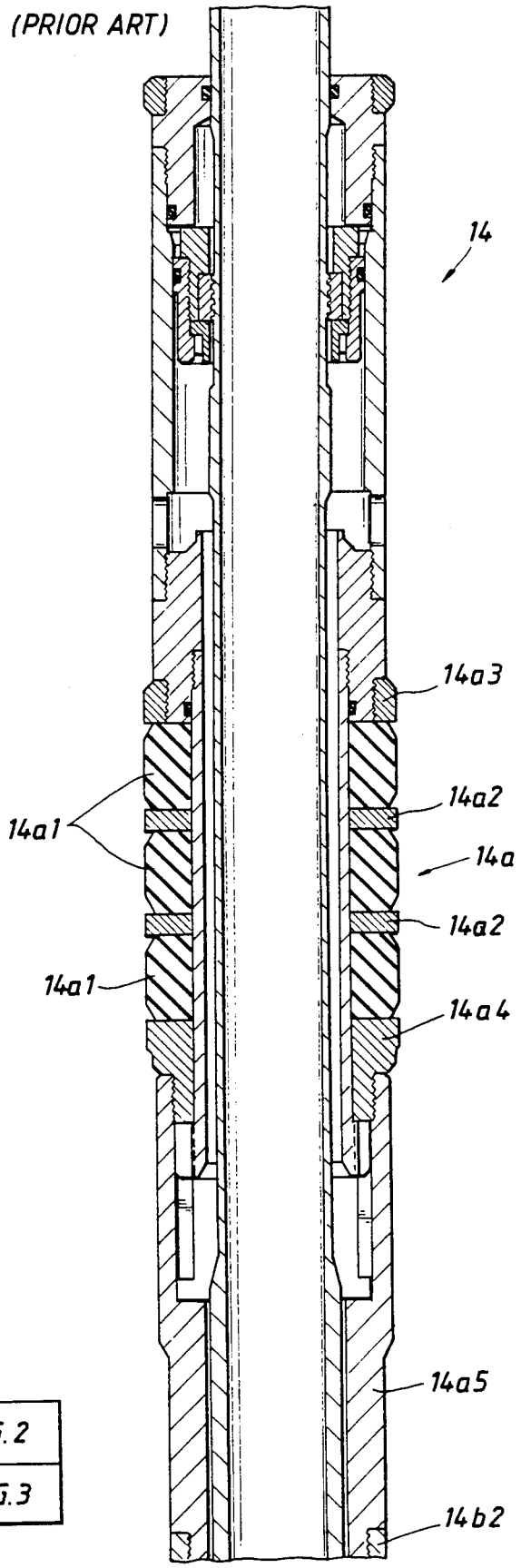
FIG. 2
FIG. 3

20

| |
|---|
| FIG. 4 |
| FIG. 5 |
| FIG. 6 |

HYDRAULICALLY SET PACKER USEFUL WITH INDEPENDENTLY SET STRADDLE PACKERS INCLUDING AN INFLATE/DEFLATE VALVE AND A HYDRAULIC RATCHET ASSOCIATED WITH THE STRADDLE PACKERS

BACKGROUND OF THE INVENTION

The subject matter of the present invention relates to packers used in association with oil exploration, and more particularly, to a hydraulically set packer adapted to be used in association with independently set straddle packers, to a hydraulic ratchet used in association with compression set straddle packers, and to an inflate deflate valve used in association with inflatable straddle packers.

In certain circumstances, one packer, disposed around a tubing in a borehole, should be set independently of the setting of another packer disposed around the tubing in the borehole. For example, a pair of straddle packers may be disposed around a tubing in a borehole, the straddle packers being either inflatably set or compression set. Circumstances may arise where a third packer, also disposed around the tubing, should be set independently of the setting of either straddle packer. Therefore, there is a need for a third packer which may be set hydraulically, and not by inflation or compression. Furthermore, if the straddle packers are inflation set, when it is necessary to deflate the inflated straddle packer, it is possible that the packer may not deflate normally, as it should. Consequently, an alternate means is required for deflating the inflated straddle packer. On the other hand, if the straddle packer is compression set, a top straddle packer on the tubing should not be set until a bottom straddle packer on the tubing is first set. Consequently, a means is required for setting the top straddle packer only when the bottom straddle packer is first set.

SUMMARY OF THE INVENTION

Accordingly, it is a primary object of the present invention to provide a packer which is hydraulically set.

It is a further object of the present invention to provide a hydraulically set packer in a configuration including an additional pair of straddle packers, the straddle packers being set independently of the setting of the hydraulic packer, such as by compression or inflation.

It is a further object of the present invention to provide an inflate-deflate valve for use with an inflatable packer that provides two means of deflating the packer.

It is a further object of the present invention to provide the inflate-deflate valve in a configuration including a pair of inflatable straddle packers, the valve being associated with each straddle packer and enabling the inflatable packer to deflate when it will not deflate by other normal means.

It is a further object of the present invention to provide a hydraulic ratchet for use with a pair of compression set packers on a tubing, the ratchet enabling a top packer of the pair on a tubing to set only when a bottom packer of the pair is first set.

In accordance with these and other objects of the present invention, a pair of straddle packers are disposed around a tubing. A separate packer is also disposed around the tubing and is spaced from the straddle packers. The straddle packers may be inflatably set or compression set. In certain circumstances, it may be necessary to set the separate packer independently of the setting of the straddle packers. As a result, in accordance with one object of the invention, the separate packer includes a structure which will enable it to set in response to changes in hydraulic pressure, not be inflation or compression. If the straddle packers are inflate-set packers, an inflate deflate valve is associated with the straddle packers for enabling the inflate set straddle packers to deflate by two different means. If the straddle packers are compression set, it may be necessary to set a top straddle packer only after the bottom straddle packer is first set. Accordingly, a hydraulic ratchet disposed adjacent the top straddle packer will enable the top straddle packer to set only when the bottom straddle packer is first set.

Further scope of applicability of the present invention will become apparent from the detailed description presented hereinafter. It should be understood, however, that the detailed description and the specific examples, while representing a preferred embodiment of the present invention, are given by way of illustration only, since various changes and modifications within the spirit and scope of the invention will become obvious to one skilled in the art from a reading of the following detailed description.

BRIEF DESCRIPTION OF THE DRAWINGS

A full understanding of the present invention will be obtained from the detailed description of the preferred embodiment presented hereinbelow, and the accompanying drawings, which are given by way of illustration only and are not intended to be limitative of the present invention, and wherein:

FIG. 1 illustrates a tubing in a borehole including a first and second straddle packer and a third separate packer;

FIGS. 2–3 illustrate a hydraulic ratchet used in association with compression set straddle packers;

DETAILED DESCRIPTION OF THE PREFERRED EMBODIMENT

Figure 3:
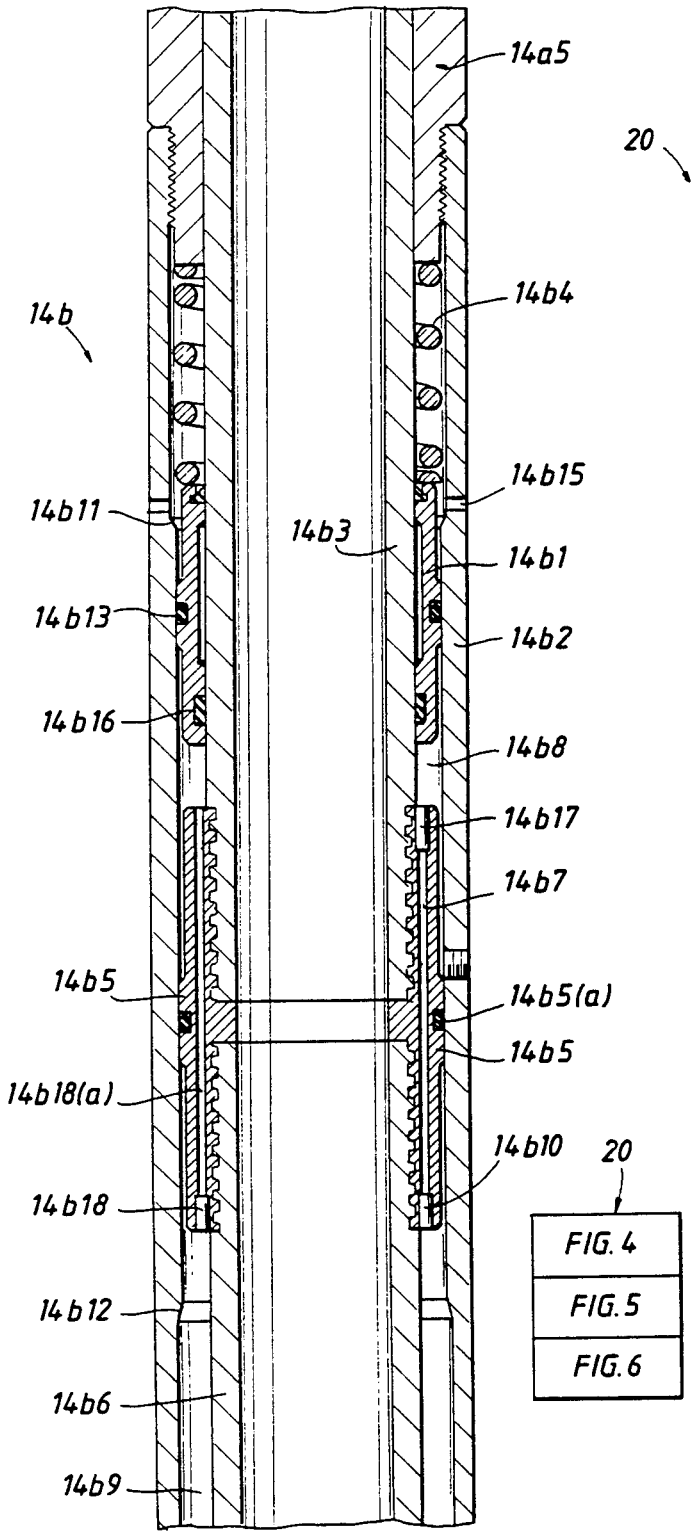

Referring to FIG. 1, a section of tubing 10 is shown disposed in a borehole lined by a casing 12. Three packers are disposed around the tubing 10 and seal the tubing 10 against a surface of the borehole. A first straddle packer 14 and a second straddle packer 16 are disposed opposite one another on one section of tubing 10 and a separate packer 20 is shown spaced from the first straddle packer 14 on another section of the tubing 10. Circumstances may arise where the straddle packers 14 and 16 should be set by a method and apparatus which is different than that of the separate packer 20. Therefore, if the straddle packers 14 and 16 are either inflatable or compression set packers, in accordance with one aspect of the present invention, separate packer 20 is a hydraulically set packer. In addition, assuming that the straddle packers 14 and 16 are inflatable packers, when it is necessary to deflate the inflatably-set straddle packers 14 and 16, the straddle packers 14 and 16 may require alternate means of deflation. Therefore, an additional apparatus is needed for deflating the inflatably set straddle packers 14 and 16. On the other hand, assuming that the straddle packers 14 and 16 are compression set packers, when it is necessary to set the first straddle packer 14, which happens to be the top straddle packer on the tubing 10 in the borehole, it is often necessary to set the first straddle packer 14 only when the second straddle packer 16 is already in a set condition. Therefore, a further additional apparatus is needed to allow the setting of the first, top straddle packer 14 only when the second straddle packer 16 is already in a set condition.

Referring to FIGS. 2 and 3, a construction of the further additional apparatus, for allowing the setting of the first straddle packer 14 only when the second straddle packer 16 is already in a set condition, is illustrated. FIG. 2 illustrates the upper straddle packer 14, which is a compression set packer 14*a*. FIG. 3 illustrates a hydraulic ratchet 14*b* which is the further additional apparatus that allows the first, upper straddle packer 14 to be set only when the second straddle packer 16 is already set.

The upper straddle packer 14 of FIG. 1 may include a compression set packer 14*a* of FIG. 2 and an associated hydraulic ratchet 14*b* of FIG. 3 connected immediately below the compression set packer 14*a*. FIG. 2 illustrates a typical compression set packer 14*a* of the prior art and FIG. 3 illustrates the associated hydraulic ratchet 14*b* in accordance with one aspect of the present invention.

In FIG. 2, the compression set packer 14*a* of the prior art includes a plurality of rubber elements 14*a*1 and an anti-extrusion ring 14*a*2 interposed between adjacent rubber elements 14*a*1. A first gauge ring 14*a*3 is connected immediately above the uppermost rubber element 14*a*1, the first gauge ring adapted to apply a downward force on the uppermost rubber element 14*a*1. A second gauge ring 14*a*4 is connected immediately below the lowermost rubber element 14*a*1, the second gauge ring adapted to apply an upward force on the lowermost rubber element 14*a*1. The upward force is provided by the lower straddle packer 16 which is set prior to the setting of the upper straddle packer 14. A lower outer housing 14*a*5 is connected to the second gauge ring 14*a*4, on one end, and to the hydraulic ratchet 14*b* on the other end. When the downward force is applied on the uppermost rubber element 14*a*1 by the first gauge ring 14*a*3, and the upward force is applied on the lowermost rubber element 14*a*1 by the second gauge ring 14*a*4, the rubber elements 14*a*1 are compressed together thereby expanding the rubber elements 14*a*1 radially outward until the elements contact the well casing 12. When this occurs, the packer of FIG. 2 is set.

In FIG. 3, the hydraulic ratchet 14*b* in accordance with one aspect of the present invention, is connected immediately below the lower outer housing 14*a*5 of the compression set packer 14*a* of FIG. 2. The hydraulic ratchet 14*b* includes a compensating piston 14*b*1 disposed between a ratchet outer housing 14*b*2 and a ratchet inner housing 14*b*3. A spring 14*b*4 is interposed between the compensating piston 14*b*1 and the lower outer housing 14*a*5 of compression set packer 14*a*. An O-ring 14*b*13 is disposed in compensating piston 14*b*1, the O-ring 14*b*13 sealing ratchet outer housing 14*b*2 against compensating piston 14*b*1 provided that the O-ring 14*b*13 is disposed below an undercut 14*b*11 in ratchet outer housing 14*b*2. A channel 14*b*15 is disposed through the ratchet outer housing 14*b*2 immediately above the undercut 14*b*11.

In addition, in FIG. 3, an inner piston mandrel 14*b*5 is interposed between the ratchet outer housing 14*b*2 and the ratchet inner housing 14*b*3, a top part of the mandrel 14*b*5 being threadedly connected to the ratchet inner housing 14*b*3 thereby defining an oil filled upper chamber 14*b*8 disposed between the mandrel 14*b*5 and the compensating piston 14*b*1, on two sides, and between the ratchet outer housing 14*b*2 and the ratchet inner housing 14*b*3, on the other two sides. A bottom part of the mandrel 14*b*5 is threadedly connected to a further ratchet inner housing 14*b*6. An oil filled chamber 14*b*9 is defined, on three sides, by the ratchet outer housing 14*b*2, the further ratchet inner housing 14*b*6, and the mandrel 14*b*5. A port 14*b*7 runs longitudinally through the wall of the inner piston mandrel 14*b*5 communicating the oil filled chamber 14*b*9 with the oil filled upper chamber 14*b*8; however, a metering valve 14*b*17 is connected to an uppermost part of the port 14*b*7 and a relief valve 14*b*10, having a predetermined rating, is connected to a lowermost part of the port 14*b*7; therefore, before the oil filled chamber 14*b*9 can communicate with the oil filled upper chamber 14*b*8, the pressure of the oil disposed in the oil filled chamber 14*b*9 must exceed the predetermined rating of the relief valve 14*b*10. The metering valve 14*b*17 meters the transfer of oil from the lower chamber 14*b*9 to the upper chamber 14*b*8 thereby providing a time delay between the time when a setting weight is applied to the packer to overcome the predetermined rating of the relief valve 14*b*10 and the time when the packer is actually set; the time delay is adjusted with the size of the metering valve and should provide a delay long enough to allow one to push the packer through an obstruction in a borehole without setting the packer.

A check valve 14*b*18 is connected to the lower end of a further port 14*b*18(*a*) running longitudinally through an opposite wall of the inner piston mandrel 14*b*5, the check valve 14*b*18 allowing free flow from the upper chamber 14*b*8 to the lower chamber 14*b*9 when a pulling force is exerted on the lower straddle packer 16. This ensures that all the pulling force is utilized to unset the packer 16. It also provides a complete recoil of the inner piston mandrel 14*b*5 during exertion of the pulling force on packer 16 and therefore ensures that the full extent of the time delay, associated with the metering valve 14*b*17, is available when a subsequent pushing force is exerted on the lower straddle packer 16 and the packer 16 is being worked through an obstruction in a borehole.

The spring 14*b*4 is used while filling the oil filled chambers 14*b*8 and 14*b*9. As oil is pumped into the chambers, the spring 14*b* is compressed thereby allowing O-ring 14*b*13 in compensating piston 14*b*1 to pass the undercut 14*b*11 in ratchet outer housing 14*b*2 and allowing air to bleed off via channel 14*b*15. A seal 14*b*16 seals inner housing 14*b*3 and compensating piston 14*b*1. When the pump pressure is bled off, the spring repositions the piston 14*b*1 in a sealing position thereby allowing O-ring 14*b*13 to seal the ratchet outer housing 14*b*2 against the compensating piston 14*b*1. The rating of relief valve 14*b*10 is determined to provide enough force on the lower packer to set the lower packer before the upper packer is set.

A functional operation of the upper, first straddle packer 14, including the compression set packer 14*a* in conjunction with the hydraulic ratchet 14*b*, is set forth in the following paragraph with reference to FIGS. 2 and 3 of the drawings.

The primary function of the hydraulic ratchet 14*b* is to prevent the compression set packer 14*a* from setting until the lower straddle packer 16 is first set, especially in a horizontal section of the well. Therefore, in the following functional description, assume that the lower straddle packer 16 is in a set condition, and that the upper straddle packer 14 (which includes the compression set packer 14*a*) is not yet in a set condition. Based on these assumptions, the intent is now to set the compression set packer 14*a*. To do this, a downward force is placed on the compression set packer 14*a* by a user at the well surface. When the downward force is applied to the first gauge ring 14*a*3 of the compression set packer 14*a*, the oil in oil filled chamber 14*b*9 applies pressure to the relief valve 14*b*10 of the ratchet 14*b*. When a predetermined threshold downward force is applied to the first gauge ring 14*a*3, the pressure applied to the relief valve 14*b*10 by the oil in the oil filled chamber 14*b*9 exceeds the predetermined rating of the relief valve. As a result, the oil in chamber 14*b*9 begins to flow through the relief valve 14*b*10, through the port 14*b*7, and into the upper chamber 14*b*8. At this point, the mandrel 14*b*5 can move down thereby applying a downward force on the rubber elements 14*a*1, the downward force being applied to the first gauge ring 14*a*3 of the compression set packer 14*a* by the user at the well surface, and the upward resisting force is being applied through the lower outer housing 14*a*5 and its extensions resting on the lower straddle packer 16. The piston 14*b*2 is present to accommodate volume change of the oil, due to pressure or temperature changes. As a result, the rubber elements 14*a*1 of compression set packer 14*a* begin to compress, expanding the rubber elements 14*a*1 radially outward until the elements contact the well casing 12. The upper straddle packer 14 is now set. When a seal 14*b*5(*a*) of mandrel 14*b*5 passes a further undercut 14*b*12, the oil in chamber 14*b*9 is free to flow around the seal 14*b*5(*a*), bypassing the relief valve, making sure that all the weight set on the packer is used to compress the rubber elements. If the lower straddle packer 16 had not been previously set, the oil in the oil filled chamber 14*b*9 would not have placed enough pressure on the relief valve 14*b*10 to overcome the predetermined rating of the relief valve 14*b*10; thus, the above referenced sequence of events would not have transpired to set the upper straddle packer 14, and in particular, the compression set packer 14*a*.

In addition to ensuring that the upper straddle packer is set only after the lower straddle packer has been set, the hydraulic ratchet 14*b* allows the upper and lower straddle packer assembly to be pushed into horizontal boreholes. When the straddle packer assembly is being pushed into a horizontal borehole, a friction force is generated by the lower straddle packer against a surface of the horizontal borehole. The predetermined rating of the relief valve 14*b*10 is set at a level high enough to prevent the predetermined rating of the relief valve from being exceeded by the friction force being generated between the lower straddle packer and the surface of the horizontal borehole.

Figure 4:
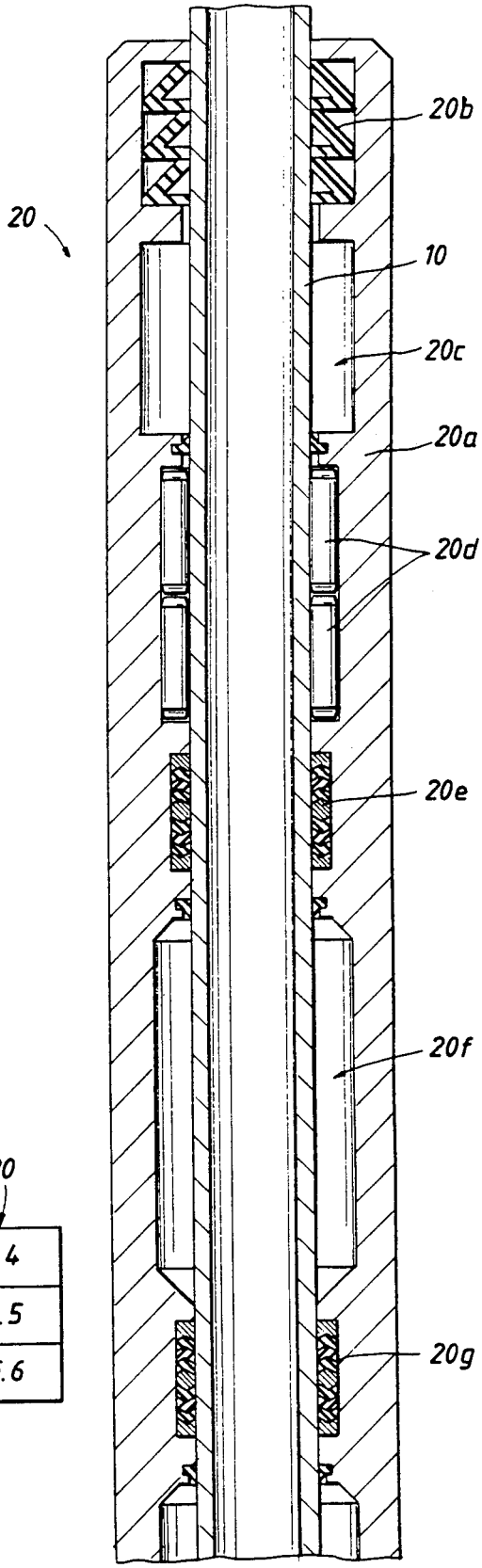
FIGS. 4–6 illustrate the hydraulically set separate packer.
Figure 5:
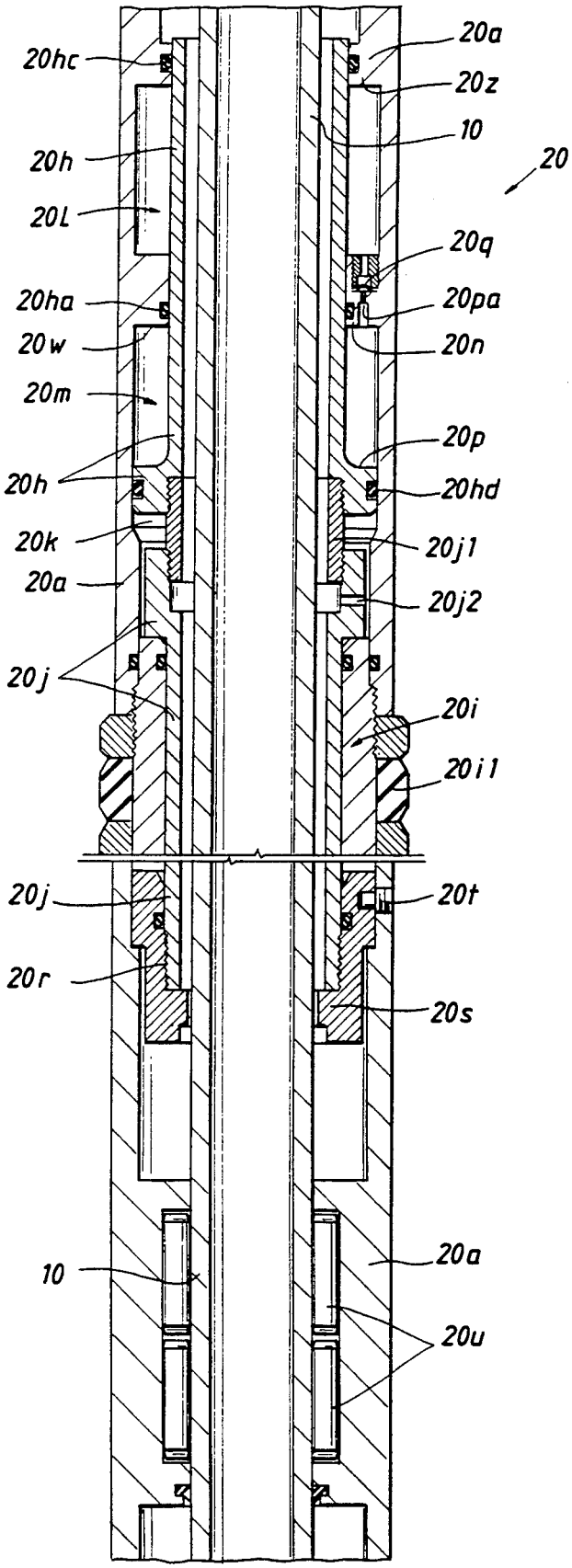
Figure 6:
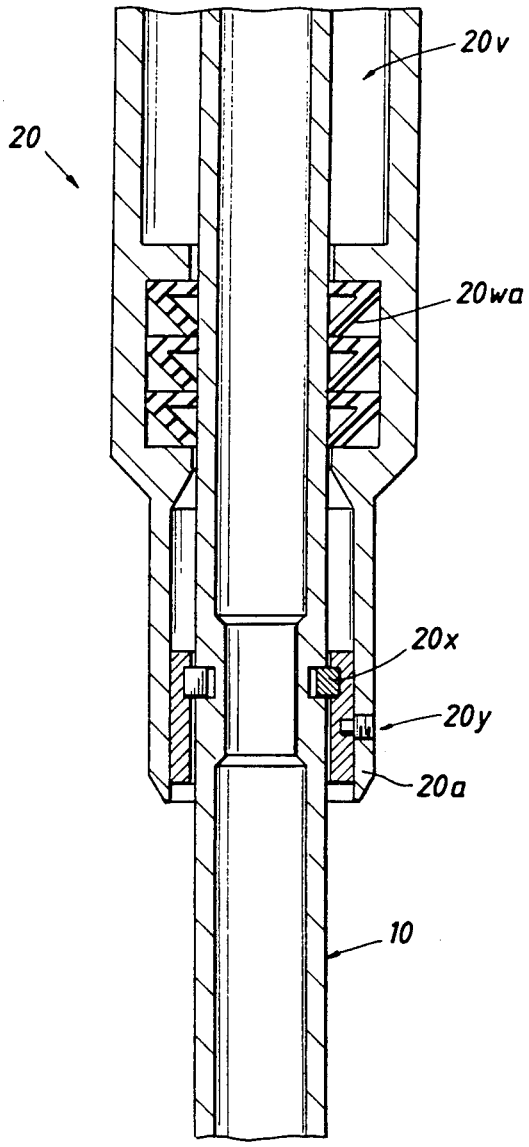

Referring to FIGS. 4–6, a construction of the separate packer 20 of FIG. 1 is illustrated. The separate packer 20 is a hydraulic packer, as opposed to the two straddle packers 14 and 16 which may be compression set packers. The objective is to set the hydraulic separate packer 20 independently of the setting of the two straddle packers 14 and 16, and to subsequently enable the tubing 10 to slide freely within the separate packer 20 when the separate packer 20 is set. When the tubing 10 slides freely within the separate packer 20, the two straddle packers 14 and 16 may be unset in response to movement of the tubing 10, the straddle packers being subsequently moved up or down to be reset at a different depth.

The separate packer 20 is attached to a flush outer diameter section of the outer tubing 10 above the upper straddle packer 14 and includes, in FIG. 4, a separate packer outer housing 20*a*, the outer housing 20*a* forming, in FIG. 4, several cavities or chambers between the outer housing 20*a* and the outer tubing 10; for example, a first chamber in which wipers 20*b* are disposed, a second chamber in which grease 20*c* is disposed, a third chamber in which bearings 20*d* are disposed, a fourth chamber in which seals 20*e* are disposed, a fifth chamber in which grease 20*f* is disposed, and a sixth chamber in which seals 20*g* are disposed. In FIG. 5, an upper mandrel 20*h* is disposed between the separate packer outer housing 20*a* and the outer tubing 10. A packer 20*i* including rubber elements 20*i*1 is connected threadedly to the lowermost part of separate packer outer housing 20*a*. A top part of a lower mandrel 20*j* is threadedly connected to the upper mandrel 20*h* via a threaded joint 20*j*1 thereby defining a seventh chamber 20*k* between the upper mandrel 20*h* and the lower mandrel 20*j*; the lower part of the lower mandrel 20*j* is disposed between the packer 20*i* and the outer tubing 10. A first port 20*j*2 is disposed through the top part of lower mandrel 20*j* and through the threaded joint 20*j*1 communicating the seventh chamber 20*k* with annulus fluid pressure. In addition to the seventh chamber 20*k*, other chambers in FIG. 5 are defined between the separate packer outer housing 20*a* and the upper mandrel 20*h*: an eighth chamber 20L which is an atmospheric chamber; and a ninth chamber 20*m* which is a fluid (e.g., oil) filled chamber. A portion 20*n* of the outer housing 20*a* separates the eighth chamber 20L and the ninth chamber 20*m*, the portion 20*n* of housing 20*a* including a second port communicating the ninth chamber 20*m* with the eighth chamber 20L, the second port further including an oil metering orifice 20*pa* and a rupture disc 20*q*. The rupture disc holds the oil back into the oil chamber and is subjected to the full pressure of the oil. The rupture disc 20*q* is designed to rupture when the oil pressure in ninth chamber 20*m* exceeds a predetermined threshold rating of the rupture disc 20*q*.

Outer housing 20*a* slides on mandrel 20*h*. Its motion is limited by the oil in oil chamber 20*m*. As seal 20*hc* diameter approximately equals seal 20*ha* diameter, it will be obvious to those skilled in the art that outer housing 20*a* and mandrel 20*h* define two piston members 20*p* and 20*w* of similar areas equal to the seal area between seal 20*hc* and seal 20*hd*. As the separate packer 20 is lowered into the well, the hydrostatic pressure of the fluid in the well pushes piston 20*z* and 20*p* towards each other, compressing the oil in chamber 20*m* until the oil pressure equals the well fluid hydrostaic pressure and a balanced state is achieved. Therefore, the oil pressure is equal to the hydrostatic pressure of the well fluid and the rupture disc is subjected to the hydrostatic pressure at all times.

The bottom portion of lower mandrel 20*j*, at 20*r*, threadedly connects to a member 20*s*, the member 20*s* being connected to separate packer outer housing 20*a* by shear pin 20*t*. Further chambers formed between the outer housing 20*a* and the outer tubing 10 include a tenth chamber which includes bearings 20*u*, an eleventh chamber in FIG. 6 which includes grease 20*v*, and a twelfth chamber in FIG. 6 which includes wipers 20*wa*.

A packer releasing split ring 20*x* and a packer running shear pin 20*y* connects the bottom of housing 20*a* to outer tubing 10.

A functional description of the separate packer 20 will be set forth in the following paragraph with reference to FIGS. 4–6.

An operator at the well surface increases pressure within the annulus between tubing 10 and casing by introducing fluid into the annulus. This pressure, outside of tubing 10, increases the pressure of the oil within ninth chamber 20*m*. The pressure is increased until it causes rupture disc 20*q* to rupture thereby allowing communication between atmospheric chamber 20L and oil chamber 20*m*. The atmospheric chamber 20L and oil chamber 20*m* become one chamber defined by pistons 20*p* and 20*z*. Pistons 20*p* and 20*z* have hydrostatic well fluid pressure on the outside and atmospheric pressure on the inside and are therefore pushed towards each other. During this motion, oil is transferred from the oil chamber 20*m* to the atmospheric chamber 20L at a rate regulated by the size of the metering orifice 20*pa*. Piston 20*p* is held down by sleeve 20*j*1: therefore, piston 20*z* travels down, compressing the rubber elements via housing 20*a* and expanding the rubber elements 20*i*1 radially outwardly until the rubber elements engage the slips against the casing. When the compression force existing in rubber elements 20*i*1 is larger than the tension resistance of tension sleeve 20*j*1, the tension sleeve 20*j*1 ruptures, thereby ending the compression setting sequence of rubber elements 20*i*1. When tension sleeve 20*j*1 ruptures, the compression force, being applied to the flush outer diameter tubing 10, shears the shear pin 20*y* thereby allowing the outer tubing 10 to slide through the separate packer 20. After the tension sleeve 20*j*1 ruptures, the compression force within the rubber elements is retained by a separate ratchet mechanism, not shown. The packer 20 is now set and outer tubing 10 may now move freely through the separate packer 20 to operate the two straddle packers 14 and 16 after shearing shear pin 20*y*.

Figure 7:
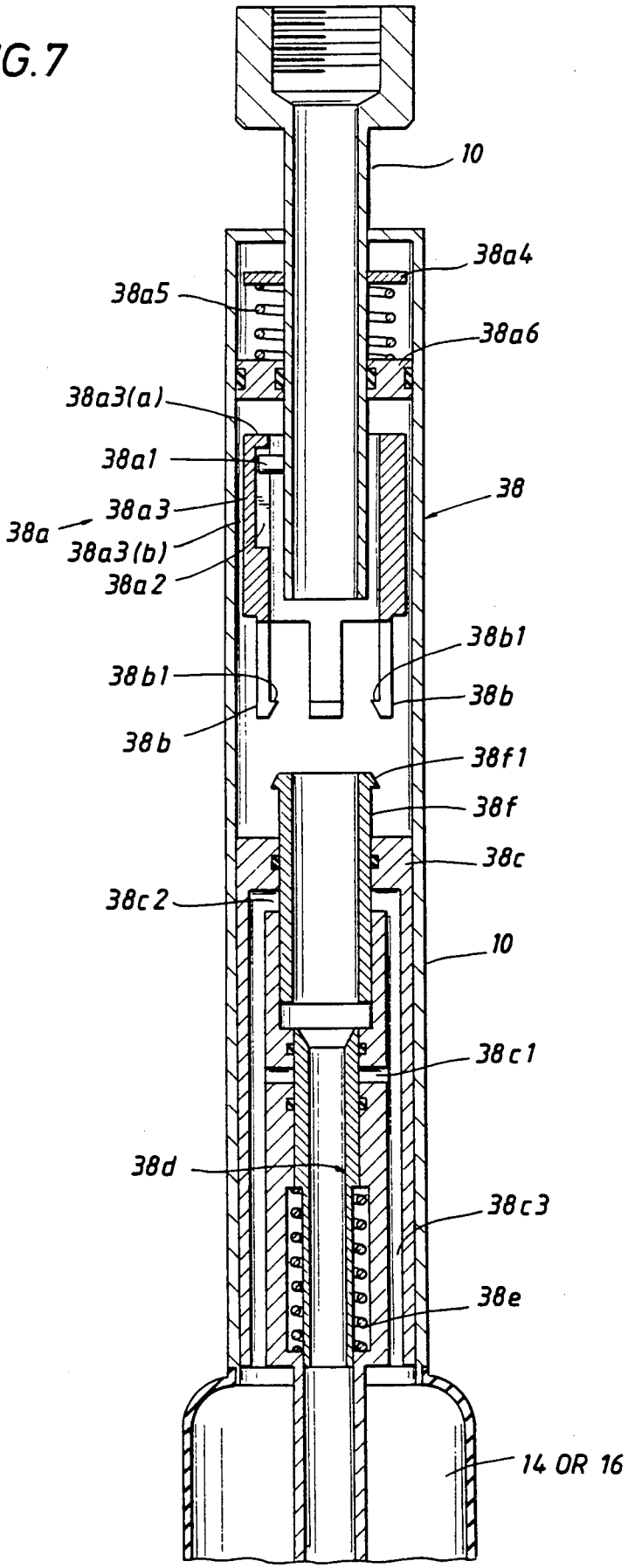
FIG. 7 illustrates an inflate deflate valve used in association with inflate set straddle packers.

Referring to FIG. 7, a construction of a hydraulic inflate deflate valve 38 is illustrated. As previously mentioned, the inflate deflate valve 38 is connected to each such inflatable straddle packer 14 and 16 for providing two means for deflating the straddle packer.

If the straddle packers 14 and 16 are inflatable packers, the inflate/deflate valve 38 enables a user at the well surface to inflate the straddle packers and provides two means of deflating the packers. The inflate/deflate valve 38 includes a clutch section 38*a* which further includes an indexing pin 38*a*1, an indexing sleeve 38*a*3 which includes a transverse part 38*a*3(*a*) and a longitudinal part 38*a*3(*b*), and a deflate collet 38*b*, an indexing slot 38*a*2 being formed by the transverse 38*a*3(*a*) and longitudinal 38*a*3(*b*) part of the sleeve 38*a*3 and the deflate collet 38*b*. The pin 38*a*1 is connected to outer tubing 10 and moves within the slot 38*a*2 in response to movement of outer tubing 10. The deflate collet 38*b* is connected to the longitudinal part 38*a*3(*b*) of sleeve 38*a*3; when the indexing pin 38*a*1 moves within slot 38*a*2, and contacts the collet 38*b*, the collet 38*b* moves downward in response to continued downward movement of piston 38*a*1. A bottom part of collet 38*b* includes a hook 38*b*1. The inflate deflate valve 38 further includes an intermediate housing portion 38*c* connected to an inner wall of outer tubing 10, the intermediate housing portion 38*c* having two ports disposed therethrough, a first port 38*c*1 and a second port 38*c*2, both ports 38*c*1 and 38*c*2 being communicable with an internal space within inflatable packer 20 via a common port 38*c*3 on one end, and being adapted to communicate with an internal space within the intermediate housing portion 38*c* on the other end. A movable protector sleeve 38*d* blocks the communication of first port 38*c*1 with the internal space within the intermediate housing portion 38*c*, the protector sleeve 38*d* being spring biased by spring 38*e*, the first port 38*c*1 being communicable with internal space within intermediate housing portion 38*c* when the protector sleeve 38*d* moves downwardly against the biasing force of the spring 38*e*. A movable deflate sleeve 38*f*, which includes a hook 38*f*1, blocks the communication of the second port 38*c*2 with the internal space within the intermediate housing portion 38*c*, the deflate sleeve 38*f* being movable longitudinally, the second port 38*c*2 being communicable with the internal space within intermediate housing portion 38*c* when the hook 38*b*1 of deflate collet 38*b* connects to the hook 38*f*1 of deflate sleeve 38*f* and forces the deflate sleeve 38*f* upwardly and over the second port 38*c*2 thereby removing the communication block.

A functional description of the inflate/deflate valve 38 will be set forth in the following paragraph with reference to FIG. 7.

A straddle packer 14 and/or 16 is not inflated and therefore not set. A user at the well surface desires to inflate the straddle packer. Coiled tubing, with a coiled tubing inflate tool connected to its end, may be run into outer tubing 10 to inflate the straddle packer 14 and/or 16. The inflate tool causes protector sleeve 38*d* to move downwardly below first port 38*c*1. When the protector sleeve 38*d* moves downwardly below first port 38*c*1, the first port 38*c*1 is opened and pressurized fluid, pumped through the coiled tubing, enters the internal space within the straddle packer 14 and/or 16 via first port 38*c*1 and common port 38*c*3. When inflation of the packer 14 and/or 16 is completed, the coiled tubing is moved up, causing the protector sleeve 38*d* to move upwardly in the drawing in response to the biasing force of spring 38*e* thereby closing off the first port 38*c*1. The straddle packer 14 and/or 16 remains inflated. When it is desired to deflate the straddle packer, the user has two options: (1) use a coiled tubing conveyed deflate tool similar to the coiled tubing conveyed inflate tool; the deflate tool is used to push sleeve 38*d* downward and allow the inflate pressure in the packers to vent out through ports 38*c*1, or (2) up and down motion of the pipe. In particular, the user pushes downwardly on tubing 10 thereby moving indexing pin 38*a*1 downwardly within indexing slot 38*a*2 until the pin 38*a*1 contacts the deflate collet 38*b*. Further downward movement of indexing pin 38*a*1 moves the deflate collet 38*b* downwardly until hook 38*b*1 of deflate collet 38*b* interconnects with hook 38*f*1 of deflate sleeve 38*f*. The user terminates downward movement of the tubing 10 and begins to pull upwardly on tubing 10. Since hook 38*b*1 is interconnected with hook 38*f*1, upward movement of tubing 10 will move deflate sleeve 38*f* upwardly. Eventually, deflate sleeve 38*f* will move past second port 38*c*2, opening the second port 38*c*2. When this occurs, the pressurized fluid present within the internal space of straddle packer 14 and 16 will pass from the internal space and into the internal space within outer tubing 10 via common port 38*c*3 and second port 38*c*2. Straddle packer 14 and 16 will then deflate. The inflate/deflate valve 38 enables the user at the well surface to deflate the straddle packer when the packer will not deflate with coiled tubing or when pipe motion is a preferred method.

The fast down and up motion of the tubing causes the clutch 38*a* to engage, but further down and up motion will deflate the straddle packer as described above. However, slow motion of the pipe (thermal length change) will not engage the clutch 38*a;* therefore, up and down motion will not engage the hook and no deflation will take place. Furthermore, when indexing pin 38*a*1 moves through indexing slot 38*a*2 during a first fast down-up cycle, the slot sleeve 38*a*3 moves very little. Indexing pin 38*a*1 engages indexing slot 38*a*2 in such a manner that slot sleeve 38*a*3 is moved down on the next cycle. When tubing moves down slowly, shoulder 38*a*4 pushes piston 38*a*6 via spring 38*a*5. Piston 38*a*6 motion is timed through a hydraulic time delay chamber. If piston 38*a*6 motion is slow, piston will reach slot-sleeve 38*a*3 and push it down before the pin 38*a*1 can engage slot 38*a*2. The slot is pushed "out of phase" and the pin cannot engage. For engagement, the pin has to go through a cycle before the "timed" piston readies the slot sleeve. The purpose of this feature is to ensure that the tool will deflate only when the pipe is manipulated by an operator at a surface and not when the pipe motion is slow, e.g., pipe motion generated by thermal expansion or contraction.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

We claim:

1. Apparatus adapted for placement between a first packer and a second packer in a borehole for enabling said first packer to be set only when said second packer is already set, comprising:

ratchet means disposed between said first packer and said second packer for placing by hydraulic means an upward pressure force on said first packer thereby compressing said first packer but only when said second packer is already set.

2. The apparatus of claim 1, wherein said ratchet means comprises:

an outer tubing;

an inner tubing;

a piston mandrel disposed between the outer tubing and the inner tubing, the piston mandrel having a port disposed longitudinally therethrough and adapted to move up or down when said ratchet is disposed in a borehole;

relief valve means disposed on one end of the port in said piston mandrel for opening when a pressure on said valve means exceed a predetermined value;

an oil filled chamber disposed below the piston mandrel between the inner and outer tubing;

an upper chamber disposed above the piston mandrel between the inner and outer tubing, the oil in said oil filled chamber increasing in pressure when said second packer is set and a downward force is placed on said outer tubing for setting said first packer, the pressure of said oil in said oil filled chamber rupturing said relief valve means in said piston mandrel when said pressure exceeds said predetermined value, said oil entering said port in said piston mandrel when said relief valve means ruptures, said oil entering said upper chamber thereby allowing said piston mandrel to move down, the downward motion of said piston mandrel enabling said first packer to be set.

3. A hydraulically set packer, comprising:

a plurality of compressible elements adapted for contacting a borehole casing when the elements are compressed;

an outer housing having one end in contact with the compressible elements, the outer housing including a longitudinal part and a transverse part connected to the longitudinal part, the transverse part of said outer housing including a longitudinally oriented port disposed therethrough, said port including a normally closed means disposed therein adapted for opening when a pressure exerted thereon exceeds a predetermined value; and a mandrel disposed within said outer housing and having a longitudinal part and a transverse part connected to the longitudinal part, the longitudinal part of said mandrel being in contact with said transverse part of said outer housing and the transverse part of said mandrel being in contact with the longitudinal part of said outer housing thereby forming two chambers separated by the transverse part of said outer housing, the two chambers being a first chamber having oil disposed therein and a second chamber having air disposed therein.

4. The hydraulically set packer of claim 3, wherein:

an increase in pressure on an underside of said transverse part of said mandrel increases a pressure of said oil in said first chamber, the increase in pressure of said oil in said first chamber opening said normally closed means in said longitudinally oriented port in said transverse part of said outer housing when the pressure of said oil exceeds said predetermined value, said oil entering said second chamber thereby decreasing a volume of said oil in said first chamber, said outer housing moving longitudinally with respect to said mandrel thereby exerting a force on said compressible elements and compressing said elements.

5. A valve adapted for inflating or deflating an inflatable packer, comprising:

a housing including a first port and a second port disposed therethrough, one end of said first port communicating with said inflatable packer, one end of said second port also communicating with said inflatable packer;

a first sleeve adapted for blocking the other end of said first port when said first sleeve is in a blocking position;

a second sleeve adapted for blocking the other end of said second port when said second sleeve is in a blocking position, the second sleeve including a first interconnection means disposed at one end thereof adapted for interconnecting with a second interconnection means;

interconnecting means including said second interconnection means for interconnecting with said first interconnection means of said second sleeve when said interconnecting means is forced to interconnect with said second sleeve, said first port allowing said packer to inflate when said first sleeve is removed from its blocking position with respect to said first port, said second port allowing said packer to deflate when said second interconnection means of said interconnecting means interconnects with said first interconnection means of said second sleeve and said second sleeve is removed from its blocking position with respect to said second port in response to the interconnection of said interconnecting means with said second sleeve.

6. The valve of claim 5, wherein said interconnecting means comprises a deflate collet connected to a tubing, said second interconnection means of said deflate collet including a hook, the first interconnection means of said second sleeve including a hook, the hook of said deflate collet interconnecting with the hook of said second sleeve when a downward force on said tubing forces said deflate collet to interconnect with said second sleeve.

7. An apparatus for sealing a well casing, comprising:

a first packer disposed around an outer tubing and adapted to be placed in a set condition, the first packer being an inflatable packer;

a second packer disposed around said outer tubing and spaced from said first packer, said second packer adapted to be disposed below said first packer when said apparatus is disposed in said borehole, said second packer adapted to be placed in a set condition, the second packer being an inflatable packer;

valve means connected to the inflatable first and second packers for inflating and deflating said first and second packer, each said valve means including, a housing including a first port and a second port disposed therethrough, one end of said first port communicating with said inflatable packer, one end of said second port also communicating with said inflatable packer, a first sleeve adapted for blocking the other end of said first port when said first sleeve is in a blocking position, a second sleeve adapted for blocking the other end of said second port when said second sleeve is in a blocking position, the second sleeve including a first interconnection means disposed at one end thereof adapted for interconnecting with a second interconnection means, interconnecting means including said second interconnection means for interconnecting with said first interconnection means of said second sleeve when said interconnecting means is forced to interconnect with said second sleeve, said first port allowing said packer to inflate when said first sleeve is removed from its blocking position with respect to said first port, said second port allowing said packer to deflate when said second interconnection means of said interconnecting means interconnects with said first interconnection means of said second sleeve and said second sleeve is removed from its blocking position with respect to said second port in response to the interconnection of said interconnecting means with said second sleeve;

a housing forming a part of said outer tubing and interconnecting the first packer and the second packer;

a third packer disposed around said outer tubing and spaced from said first packer, said third packer adapted to be placed in a set condition, the setting of the first and second packers being accomplished independently of the setting of said third packer, the third packer being a hydraulic packer and including, a plurality of compressible elements adapted for contacting a borehole casing when the elements are compressed, an outer housing having one end in contact with the compressible elements, the outer housing including a longitudinal part and a transverse part connected to the longitudinal part, the transverse part of said outer housing including a longitudinally oriented port disposed therethrough, said port including a normally closed means disposed therein adapted for opening when a pressure exerted thereon exceeds a predetermined value, and a mandrel disposed within said outer housing and having a longitudinal part and a transverse part connected to the longitudinal part, the longitudinal part of said mandrel being in contact with said transverse part of said outer housing and the transverse part of said mandrel being in contact with the longitudinal part of said outer housing thereby forming two chambers separated by the transverse part of said outer housing, the two chambers being a first chamber having oil disposed therein and a second chamber.

8. An apparatus for sealing a well casing, comprising:

a first packer disposed around an outer tubing and adapted to be placed in a set condition, the first packer being a compression set packer;

a second packer disposed around said outer tubing and spaced from said first packer, said second packer adapted to be disposed below said first packer when said apparatus is disposed in said borehole, said second packer adapted to be placed in a set condition, the second packer being a compression set packer;

ratchet means disposed between said first packer and said second packer for placing by hydraulic means an upward pressure force on said first packer thereby compressing and setting said first packer but only when said second packer is set;

a housing forming a part of said outer tubing and interconnecting the first packer and the second packer;

a third packer disposed around said outer tubing and spaced from said first packer, said third packer adapted to be placed in a set condition, the setting of the first and second packers being accomplished independently of the setting of said third packer, the third packer being a hydraulic packer and including, a plurality of compressible elements adapted for contacting a borehole casing when the elements are compressed, an outer housing having one end in contact with the compressible elements, the outer housing including a longitudinal part and a transverse part connected to the longitudinal part, the transverse part of said outer housing including a longitudinally oriented port disposed therethrough, said port including a normally closed means disposed therein adapted for opening when a pressure exerted thereon exceeds a predetermined value, and a mandrel disposed within said outer housing and having a longitudinal part and a transverse part connected to the longitudinal part, the longitudinal part of said mandrel being in contact with said transverse part of said outer housing and the transverse part of said mandrel being in contact with the longitudinal part of said outer housing thereby forming two chambers separated by the transverse part of said outer housing, the two chambers being a first chamber having oil disposed therein and a second chamber.

9. The apparatus of claim 8, wherein said ratchet means comprises:

an outer tubing;

an inner tubing;

a piston mandrel disposed between the outer tubing and the inner tubing, the piston mandrel having a port disposed longitudinally therethrough and adapted to move up or down when said ratchet is disposed in a borehole;

relief valve means disposed on one end of the port in said piston mandrel for rupturing when a pressure on said valve means exceed a predetermined value;

an oil filled chamber disposed below the piston mandrel between the inner and outer tubing;

an upper chamber disposed above the piston mandrel between the inner and outer tubing, the oil in said oil filled chamber increasing in pressure when said second packer is set and a downward force is placed on said outer tubing for setting said first packer, the pressure of said oil in said oil filled chamber rupturing said relief valve means in said piston mandrel when said pressure exceeds said predetermined value, said oil entering said port in said piston mandrel when said relief valve means ruptures, said oil entering said upper chamber thereby allowing said piston mandrel to move down, the downward motion of said piston mandrel enabling said first packer to be set.

10. In a system including a packer means adapted to be disposed around a tubing in a borehole for isolating a first annulus between the tubing and the borehole below the packer means from a second annulus between the tubing and the borehole above the packer means, said packer means comprising:

a first straddle packer adapted to be disposed around said tubing in said borehole;

a second straddle packer adapted to be disposed around said tubing below said first straddle packer in said borehole, the first and second straddle packers being set by a first method, said first method being a compression set method; and a separate packer adapted to be disposed around said tubing above said first straddle packer in said borehole, said separate packer being set by a second method, the second method of setting said separate packer being different than the first method of setting the first and second straddle packers.

11. The packer means of claim 10, wherein said second method is a hydraulically set method.

12. The packer means of claim 10, further comprising:

ratchet means disposed between said first straddle packer and said second straddle packer for enabling the first straddle packer to set but only when said second straddle packer is already set.

13. The packer means of claim 12, wherein said second method is a hydraulically set method.

14. In a system including a packer means adapted to be disposed around a tubing in a borehole for isolating a first annulus between the tubing and the borehole below the packer means from a second annulus between the tubing and the borehole above the packer means, said packer means comprising:

a first straddle packer adapted to be disposed around said tubing in said borehole;

a second straddle packer adapted to be disposed around said tubing below said first straddle packer in said borehole, the first and second straddle packers being set by a first method, said first method being an inflation set method, the inflation set first and second straddle packers containing liquid when the first and second straddle packers are set;

inflate-deflate valve means connected to each of the first and second straddle packers for providing an entry port for said liquid to enter the first and second straddle packers when said liquid is inflating the first and second straddle packers and for providing an exit port for said liquid to exit from the first and second straddle packers when said first and second straddle packers are being deflated; and a separate packer adapted to be disposed around said tubing above said first straddle packer in said borehole, said separate packer being set by a second method, the second method of setting said separate packer being different than the first method of setting the first and second straddle packers.

15. The packer means of claim 14, wherein said second method is a hydraulically set method.

16. In a system including a packer means adapted to be disposed around a tubing in a borehole for isolating a first annulus between the tubing and the borehole below the packer means from a second annulus between the tubing and the borehole above the packer means, said packer means comprising:

a first straddle packer adapted to be disposed around said tubing in said borehole;

a second straddle packer adapted to be disposed around said tubing below said first straddle packer in said borehole, the first and second straddle packers being set by a first method, said first method being an inflation set method; and a separate packer adapted to be disposed around said tubing above said first straddle packer in said borehole, said separate packer being set by a second method, said second method being a hydraulically set method.

17. In a system including a packer means adapted to be disposed around a tubing in a borehole for isolating a first annulus between the tubing and the borehole below the packer means from a second annulus between the tubing and the borehole above the packer means, said packer means comprising:

a first straddle packer adapted to be disposed around said tubing in said borehole;

a second straddle packer adapted to be disposed around said tubing below said first straddle packer in said borehole, the first and second straddle packers being set by a first method, said first method being a compression set method; and a separate packer adapted to be disposed around said tubing in said borehole, said separate packer being set by a second method, the second method of setting said separate packer being different than the first method of setting the first and second straddle packers.

18. The packer means of claim 17, wherein said second method is a hydraulically set method.

19. The packer means of claim 17, further comprising:

ratchet means disposed between said first straddle packer and said second straddle packer for enabling the first straddle packer to set but only when said second straddle packer is already set.

20. The packer means of claim 19, wherein aid second method is a hydraulically set method.

21. In a system including a packer means adapted to be disposed around a tubing in a borehole for isolating a first annulus between the tubing and the borehole below the packer means from a second annulus between the tubing and the borehole above the packer means, said packer means comprising:

a first straddle packer adapted to be disposed around said tubing in said borehole;

a second straddle packer adapted to be disposed around said tubing below said first straddle packer in said borehole, the first and second straddle packers being set by a first method, said first method being an inflation set method, the inflation set first and second straddle packers containing a medium when the first and second straddle packers are set;

inflate-deflate valve means connected to each of the first and second straddle packers for providing an entry port for said medium to enter the first and second straddle packers when said medium is inflating the first and second straddle packers and for providing an exit port for said medium to exit from the first and second straddle packers when said first and second straddle packers are being deflated; and a separate packer adapted to be disposed around said tubing in said borehole, said separate packer being set by a second method, the second method of setting said separate packer being different than the first method of setting the first and second straddle packers.

22. The packer means of claim 21, wherein said second method is a hydraulically set method.

23. In a system including a packer means adapted to be disposed around a tubing in a borehole for isolating a first annulus between the tubing and the borehole below the packer means from a second annulus between the tubing and the borehole above the packer means, said packer means comprising:

a first straddle packer adapted to be disposed around said tubing in said borehole;

a second straddle packer adapted to be disposed around said tubing below said first straddle packer in said borehole, the first and second straddle packers being set by a first method, said first method being an inflation set method; and a separate packer adapted to be disposed around said tubing in said borehole, said separate packer being set by a second method, said second method being a hydraulically set method.'

24. Apparatus adapted to be connected to a packer and a tubing for enabling said packer to be inflated and for deflating said packer, comprising:

first means adapted to be connected to said packer for opening thereby enabling said packer to be inflated and closing thereby retaining said packer in an inflated condition, said first means including a first interconnection means adapted for interconnecting with a second interconnection means; and second means adapted to be connected to said tubing for moving in a forward or a backward longitudinal direction, said second means including said second interconnection means adapted for connecting with aid first interconnection means of said first means in response to a movement of said second means in said forward longitudinal direction, said second means deflating the inflated packer when said second interconnection means is connected to said first interconnection means in response to a movement of said second means in said backward longitudinal direction.

* * * * *